US006158103A

United States Patent [19]

Grubb

[11] Patent Number: 6,158,103

[45] Date of Patent: Dec. 12, 2000

[54] CONVERTIBLE DESK DRAWER

[76] Inventor: Jeffrey A. Grubb, 490 S. Avenida Faro, Anaheim, Calif. 92807

[21] Appl. No.: 08/926,202

[22] Filed: Sep. 9, 1997

Related U.S. Application Data

[60] Continuation of application No. 08/545,140, Oct. 19, 1995, abandoned, which is a division of application No. 08/234,280, Apr. 29, 1994, Pat. No. 5,476,317.

[51] Int. Cl.[7] ..... B23P 11/00

[52] U.S. Cl. ..... 29/401.1; 29/434

[58] Field of Search ..... 312/308, 334.27, 312/348.2, 348.4, 7; 211/2; 248/918; 108/11, 14; 29/401.1, 434

[56] References Cited

U.S. PATENT DOCUMENTS

| | | | |
|---|---|---|---|
| 132,165 | 10/1872 | Maples | 312/308 X |
| 864,083 | 8/1907 | Cranston | 312/308 |
| 969,959 | 9/1910 | Knight | 312/308 X |
| 2,132,737 | 10/1938 | Kahn | 312/308 |
| 2,442,038 | 5/1948 | Crell | 312/308 |
| 2,630,363 | 3/1953 | Hake | 312/308 X |
| 2,690,371 | 9/1954 | Woina | 312/308 X |
| 2,692,811 | 10/1954 | Page | 312/308 |
| 3,278,248 | 10/1966 | Torok | 312/308 |
| 4,632,472 | 12/1986 | Bross . | |
| 4,759,341 | 7/1988 | McFarland . | |
| 4,934,765 | 6/1990 | Slifer, Sr. et al. . | |
| 5,205,631 | 4/1993 | Wegman et al. . | |
| 5,211,461 | 5/1993 | Teufel et al. . | |
| 5,281,020 | 1/1994 | Romick | 312/308 |
| 5,651,596 | 7/1997 | Carlson et al. . | |

FOREIGN PATENT DOCUMENTS

| | | |
|---|---|---|
| 9-054631 | 2/1997 | Japan . |
| 11-009352 | 1/1999 | Japan . |

*Primary Examiner*—S. Thomas Hughes
*Assistant Examiner*—Eric Compton
*Attorney, Agent, or Firm*—Knobbe, Martens, Olson & Bear, LLP

[57] ABSTRACT

A desk drawer includes a flat bottom wall having side runners mounted thereon. A generally rectangular frame unit is attached on top of the bottom wall to form the side walls of a desk drawer. A pencil tray is permanently mounted to the lateral side walls of the frame unit and is removably attached to the bottom wall. This provides a convenient means for attaching and re-attaching the frame unit and shelf unit.

7 Claims, 5 Drawing Sheets

CONVERTIBLE DESK DRAWER

This application is a continuation of U.S. patent application Ser. No. 08/545,140, filed Oct. 19, 1995, now abandoned which was a Division of U.S. patent application Ser. No. 08/234,280, filed Apr. 29, 1994 now U.S. Pat. No. 5,476,317.

FIELD OF THE INVENTION

The present invention relates to desk drawers and, more particularly, to a desk drawer that is convertible into a computer keyboard shelf.

BACKGROUND OF THE INVENTION

Typical office desks have the central main drawer reserved for pencils and other commonly used items. These days, whether at home or at a business, most office desks typically have a computer and an associated keyboard situated thereon. In many offices, it is convenient to place the keyboard on a shelf of a nearby stand or on a retractable shelf positioned within the desk itself. Unfortunately, the number of pieces of office furniture is often limited, and a choice between a central pencil drawer and a computer shelf is often made.

The manufacturers of desks must produce two types of desk inserts—drawers and computer shelves—to provide in the finished desks. Further, distributors and retail outlets must accommodate the needs of different consumers and deliver, stock and market both types of desks. Extra expenses for fabrication, assembly, inventory, shipping and receiving, and sales for two basically similar desks are therefore incurred.

In the past there have been attempts to provide a conventional drawer that can convert into a platform or shelf for a keyboard. One such attempt involves removing the drawer and replacing the drawer slide hardware onto a separate shelf. This requires a significant amount of conversion work and associated time to convert from one mode to the other. More importantly, many consumers have difficulty with or do not like to undertake such tasks.

In another attempt, a conventional desk drawer is provided with a hinged front wall, which can be tilted forward so that the computer operator's hands can be placed there to operate a keyboard within the drawer. The drawback here is that the front wall of the drawer is attached by necessarily small hinges, which rapidly wear or are broken easily, especially since the wall is continually used as a hand support. Further, the hinged portion is always somewhat unstable. Also, the side walls of the drawer interfere with free use of the space surrounding the keyboard, requiring an operator to sit directly in front of the keyboard with the arms restricted to a relatively narrow corridor of movement.

Accordingly, there is a need for a simplified and sturdy arrangement for converting a conventional desk drawer into a shelf for a keyboard.

SUMMARY OF THE INVENTION

The present invention provides an improved desk drawer that can be easily converted from either a conventional desk drawer into a keyboard shelf, or vice versa. The convertible desk drawer comprises a shelf unit and a generally rectangular side wall frame unit demountably attached to the shelf unit. The shelf unit includes a flat bottom floor having sliders attached to either lateral edge. The shelf unit is sized to fit within guides of a drawer cavity in a desk.

In the preferred embodiment, the side wall frame is defined by two lateral side walls, a rear wall, and a front wall, all the walls being securely attached together at their corners at right angles. A pencil holder or tray is rigidly attached between the front ends of the lateral side walls, abutting the front wall. The pencil tray includes a pair of dead end wood screw holes extending from a lower surface, which are spaced the same as a pair of holes formed in the front end of the shelf unit bottom. The frame can thus be attached to the bottom by two coupling members extending upward from the holes in the shelf unit and into the dead end holes in the pencil tray. The frame assembly can be easily demounted from the shelf unit to form a keyboard shelf. In a preferred version, wood screws serve as coupling members which extend through holes from below the shelf unit bottom into the pencil tray. Likewise, if a conventional drawer is needed again, the frame can be mounted via the wood screws.

DESCRIPTION OF THE PREFERRED EMBODIMENTS

Figure 1:
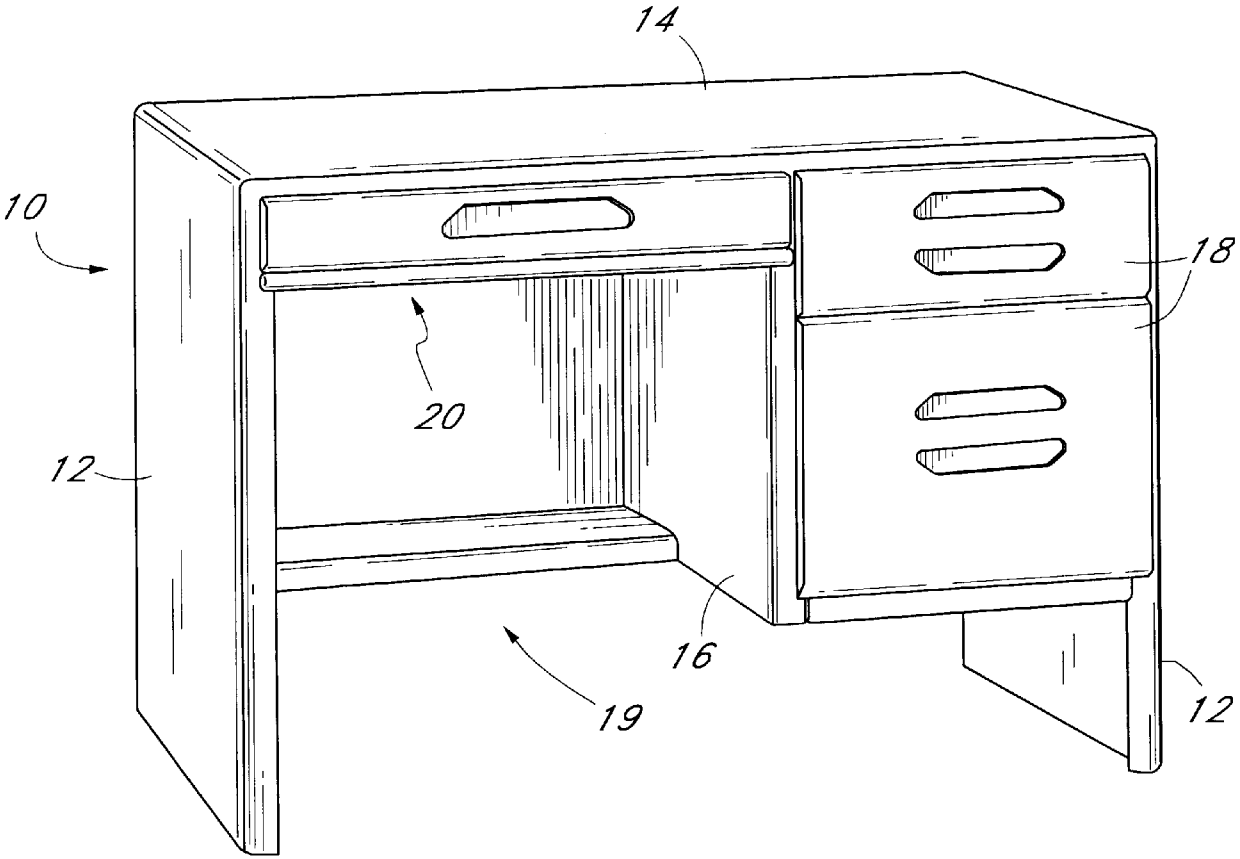
FIG. 1 is a perspective view of a desk with the desk drawer of the present invention.
Figure 2:
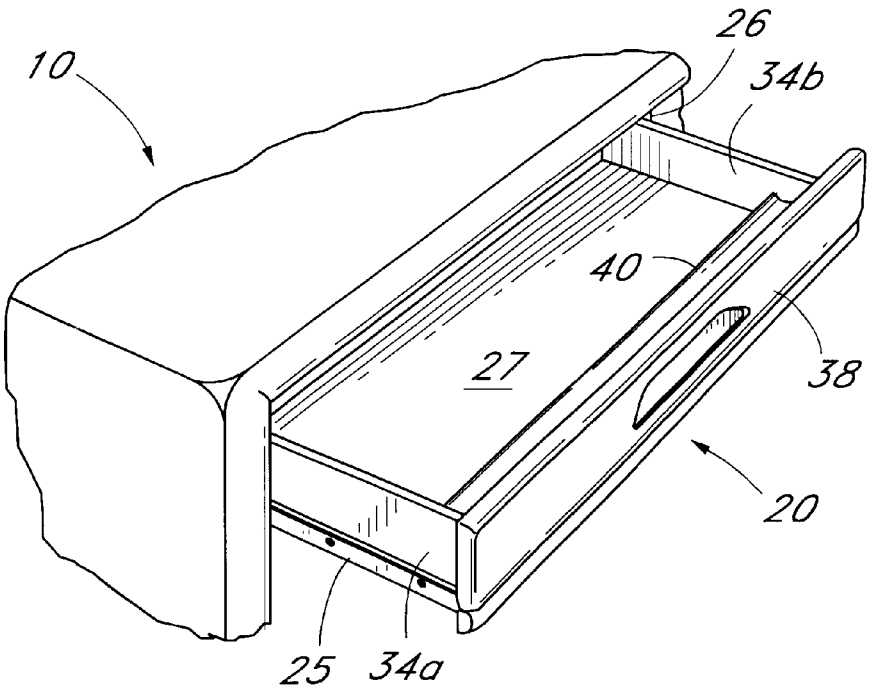
FIG. 2 is a perspective view of the convertible desk drawer of the present invention in a conventional drawer mode.
Figure 3:
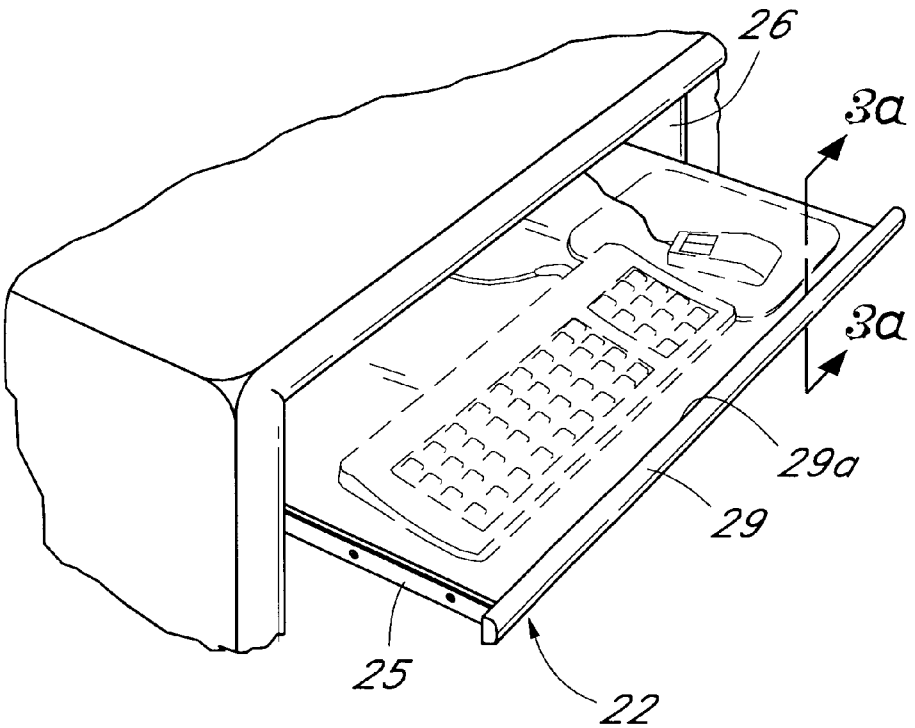
FIG. 3 is a perspective view of the convertible desk drawer in a keyboard shelf mode.
Figure 3A:
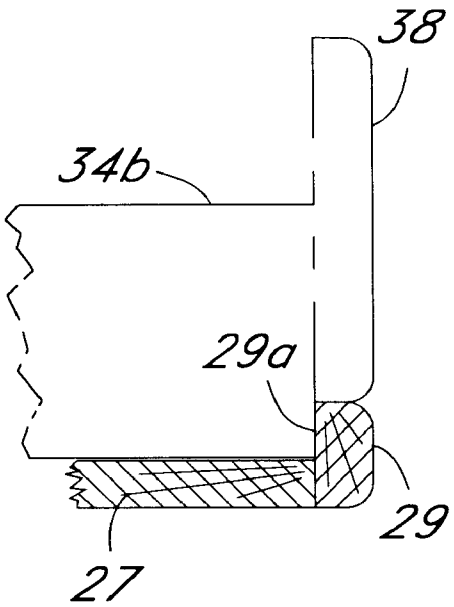
FIG. 3*a* is a sectional view of a front lip of the keyboard shelf taken along line 3*a*—3*a* of FIG. 3.
Figure 4:
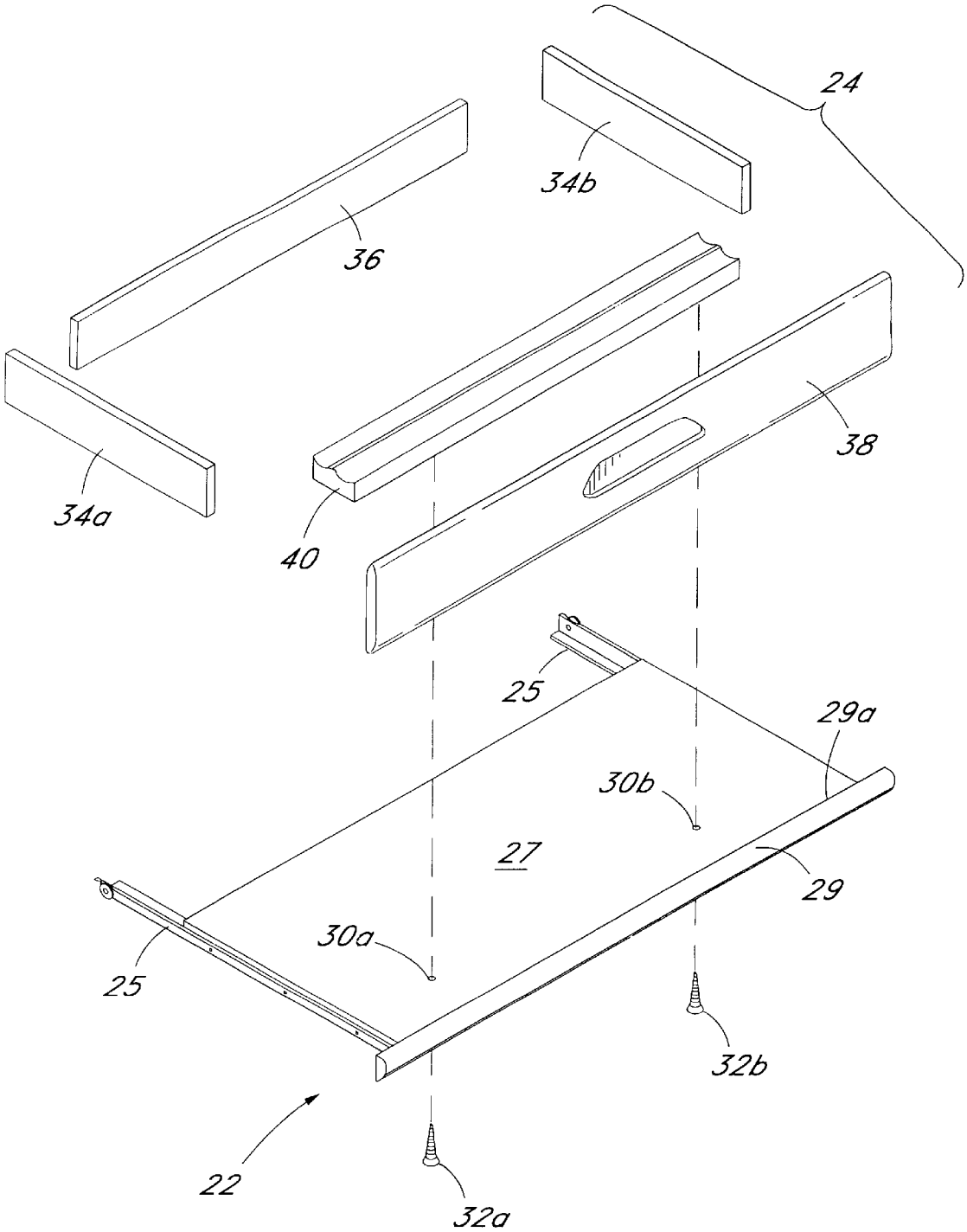
FIG. 4 is an exploded perspective view of the preferred convertible desk drawer of the present invention.

With reference to FIG. 1, a desk 10 comprises a pair of side legs 12, a desktop 14, and a panel 16 which segregates the space below the desktop into a file drawer 18 region and an open space 19 for accommodating a person's legs. A convertible desk drawer 20 of the present invention is slidably mounted across the open space 19. The convertible desk drawer 20 is shown in a conventional drawer mode in FIG. 2, while FIG. 3 shows the convertible desk drawer in a keyboard shelf mode. The conversion between the two modes is best described with reference to the exploded view of FIG. 4.

The desk drawer 20 generally comprises a lower flat shelf unit 22 and an upper frame unit 24. The shelf unit 22 includes a pair of side runners or sliders 25, which are adapted to fit within conventional guides (not shown) mounted within a desk drawer cavity 26 of the desk 10, as best seen in FIGS. 2 and 3. The desk drawer cavity 26 is sized under the desktop 14 and within the space 19 so the desk drawer 20 operates above the legs of a user sitting at the desk. The sliders 25 typically comprise slide wheels mounted for rotation on an elongated bracket which is rigidly attached to either lateral edge of a bottom or floor 27 of the drawer 20. In the alternative, the sliders 25 may comprise simple guide rails or channels, or may even be eliminated in the most basic desks. The bottom 27 further includes a pair of holes 30*a,b* sized to receive a pair of wood screws 32*a,b*.

The shelf unit also includes a front strip 29 attached to the front edge of the bottom 27, the ends of the strip extending beyond the lateral edges of the bottom 27 to cover the drawer opening when the unit is closed. The upper edge 29*a* of the strip extends above the bottom 27 and is preferably rounded on its upper edges.

The upper frame unit 24 comprises a pair of lateral side walls 34*a* and 34*b*, a rear wall 36, a front wall 38, and a pencil holder or tray 40. The lateral side walls, rear wall, and front wall are joined at their corners at right angles, by suitable means. the lower edge of the front wall 38 is spaced above the lower edges of the side and rear walls so as to mate with the upper edge of the strip 27. The pencil tray 40 extends between the inner surfaces of the lateral side walls 34*a,b* and is attached thereto by suitable means. A pair of dead end screw receiving holes (not shown) are formed in the underside of the pencil tray 40 at spaced locations identical to the spacing between the through-holes 30*a,b* in the bottom 27.

The pencil unit 40 may be replaced with other structure extending between the side walls 34*a,b*, or may be eliminated, with the screws 32*a,b* mounting directly into the side walls or front wall 38. Further, attachment structure other than wood screws may be used to secure the frame unit 24 to the shelf unit 22. For instance, the frame unit 24 may include a pair of downwardly depending pins sized to fit in holes formed in the bottom 27, the frame unit thus being held on by gravity and any interference created by the pin/hole fit. In another variation, the frame unit 24 may have a pair of depending latches arranged to fit within slots having undercuts in the shelf unit 22. In this version, the frame unit 24 must first be slid transversely to release the latches from the undercuts to separate the frame unit from the shelf unit 22. Other alternative structure which allows rapid attachment and disattachment is contemplated.

In the drawer mode illustrated, the frame unit 24 is placed on top of the shelf unit 22 and the wood screws 32*a,b* inserted through the holes 30*a,b* and into the dead end holes in the bottom of the pencil tray 40. The frame unit 24 is thus securely fastened to the shelf unit. Relatively little stress is applied to the frame unit 24, and thus to the attachment screws 32*a,b*, due to the fact that the sliders 25 are mounted to the bottom 27. To convert to the keyboard shelf mode of FIG. 2, the wood screws 32*a,b* are withdrawn and the frame unit 24 simply lifted off the shelf unit 22. A keyboard, mouse, or other item is thus placed in an accessible position on the shelf unit, which can be pushed back into the drawer cavity 26 of the desk.

Thus, when the drawer unit is to be removed the sliders are not affected. Since the sliders are not attached to the drawer side walls 34*a* and 34*b* and those walls do not otherwise receive much load, the side walls and the rear wall 36 can be made of relatively thin, lightweight material. The front wall is preferably more substantial to handle a drawer pull and to match the exterior appearance of the desk. Also the front strip 29 matches the front wall.

Note that in the keyboard shelf mode, the upper edge 29*a* of front strip 29 extending above the bottom 27 creates a lip that prevents the mouse or other items from falling of the front edge. Also the lip forms a convenient rest for the operator's hands when the fingers are engaging the keyboard.

The provision of the convertible desk drawer 20 greatly reduces the cost of making and selling desks having either drawer or keyboard shelves. Indeed, only one desk drawer need be manufactured and assembled, the conversion to whichever mode is desired being done by the consumer after the sale. Further, shipping and inventory problems associated with two different desks are eliminated. Finally, and probably most importantly, the retailer can advertise either style of desk and simply convert to one or the other as the customer wishes on the spot. Never again will the retailer run out of one style of desk as both are provided using the present convertible desk drawer.

Although this invention has been described in terms of certain preferred embodiments, other embodiments that are apparent to those of ordinary skill in the art are also within the scope of this invention. Accordingly, the scope of the invention is intended to be defined by the claims that follow.

What is claimed is:

1. The method of making a convertible desk drawer/shelf comprising the steps of:

mounting a pair of drawer sliders on opposed side edges of a shelf, said shelf having a substantially planar top surface extending between said drawer sliders and without side walls extending above said top surface of said shelf;

slidably mounting the shelf into guides positioned within a drawer cavity located in an upper region of an open space formed under a desk sized to receive a person's legs when sitting at the desk;

forming a generally rectangular frame unit by connecting a pair of side walls to a rear wall and to a front wall; and mounting with fasteners said frame unit as a unit on said top surface of said shelf in a manner to permit said frame unit to be readily attached or removed from the shelf so that the shelf can be used by itself as a retractable keyboard shelf by placing a keyboard on the planar top surface, and the shelf in combination with the frame unit can be used as a retractable drawer having upstanding walls formed by said frame unit.

2. The method of claim 1, including mounting a pencil tray in said frame unit with ends of the tray engaging the side walls and a forward edge of the tray engaging said frame unit front wall.

3. The method of claim 2, including readily attaching the frame unit to the shelf by attaching the pencil tray to the shelf.

4. The method of claim 1, including positioning an elongated strip on the front edge of said shelf with an upper edge of the strip extending above the shelf so as to form a lip on the front edge of the shelf, and said frame unit forming step includes positioning a lower edge of said frame unit spaced above lower edges of said frame unit side walls so that when said frame unit is mounted on said shelf the frame unit side walls rest directly on said shelf and said frame unit front wall rest directly on said lip.

5. A method of making a convertible desk, comprising the step of:

forming a desk having an upper work surface and an open space for accommodating a person's legs;

providing a pair of drawer horizontal slides in said open space;

forming a planar shelf unit having a planar top surface and opposed lateral sides with structure mounted thereon adapted to be received by said drawer slides provided in said open space, said shelf without side walls extending above said planar top surface;

forming a frame unit having sidewalls, a front wall and a rear well, and having an open bottom, the frame unit being sized to be supported on said shelf unit top surface; and providing fasteners enabling said frame unit as an integral element to be rapidly attached and detached from said shelf unit, the convertible desk being suitable for use as a computer work station with the frame unit detached from said shelf and a keyboard mounted on the shelf, and as a conventional desk with said frame unit attached to said shelf unit to provide a conventional desk drawer with upstanding walls provided by said frame unit.

6. The method of claim 5, further comprising the step of attaching a pencil tray to interior surfaces of said frame unit and attaching said frame unit to said shelf unit using said fasteners inserted through said shelf unit into said pencil tray.

7. A method of constructing a flexible office workstation, comprising the steps of:

supplying a desk having an open space for receiving a person's legs, the desk having a pair of opposed horizontal slides in an upper portion of said open space;

installing a planar shelf unit into said open space by guiding structure provided on side edges of said shelf unit into said slides;

fastening a frame unit onto said shelf unit, the frame unit having opposed side walls and opposed front and rear walls, and having an open bottom, and having a periphery so that the frame unit is supported directly on said shelf unit to provide a retractable desk drawer; and unfastening said frame unit from said shelf unit and removing said frame unit as an integral element to provide a retractable keyboard shelf formed by said planar shelf unit.

* * * * *